US012049751B2

(12) United States Patent
Poveda et al.

(10) Patent No.: US 12,049,751 B2
(45) Date of Patent: Jul. 30, 2024

(54) BUILDING ELEMENT, SYSTEM AND METHOD

(71) Applicant: LEVIAT LIMITED, Sheffield (GB)

(72) Inventors: Hervé Marie Poveda, South Yorkshire (GB); Paul Oliver, South Yorkshire (GB)

(73) Assignee: LEVIAT LIMITED, Sheffield (GB)

( * ) Notice: Subject to any disclaimer, the term of this patent is extended or adjusted under 35 U.S.C. 154(b) by 575 days.

(21) Appl. No.: 17/296,514

(22) PCT Filed: Nov. 25, 2019

(86) PCT No.: PCT/GB2019/053322
§ 371 (c)(1),
(2) Date: May 24, 2021

(87) PCT Pub. No.: WO2020/109762
PCT Pub. Date: Jun. 4, 2020

(65) Prior Publication Data
US 2022/0127837 A1 Apr. 28, 2022

(30) Foreign Application Priority Data
Nov. 26, 2018 (GB) ..... 1819196

(51) Int. Cl.
*E04B 1/00* (2006.01)
*E04B 1/78* (2006.01)
(Continued)

(52) U.S. Cl.
CPC ..... *E04B 1/0038* (2013.01); *E04B 1/78* (2013.01); *E04B 5/36* (2013.01); *E04C 5/06* (2013.01); *E04C 5/12* (2013.01)

(58) Field of Classification Search
CPC . E04B 1/0038; E04B 1/78; E04B 5/36; E04B 5/23; E04C 5/06; E04C 3/20; E01D 19/16
See application file for complete search history.

(56) References Cited

U.S. PATENT DOCUMENTS 4,959,940 A * 10/1990 Witschi ..... E04B 1/0038 52/223.13
5,701,707 A 12/1997 Sorkin
(Continued)

FOREIGN PATENT DOCUMENTS

CH 713371 A2 7/2018
EP 1039056 A1 9/2000
(Continued)

OTHER PUBLICATIONS

Examination Report dated Oct. 19, 2023 for European Patent Office appl. 19 809 909.5 (4 pages).
(Continued)

*Primary Examiner* — Paola Agudelo
(74) *Attorney, Agent, or Firm* — FOLEY & LARDNER LLP

(57) ABSTRACT

A building element adapted to provide thermal insulation between two building parts such as a floor or ceiling slab and a balcony slab is described. The element comprises: an elongate insulating body; a plurality of reinforcing elements passing through and projecting on either side beyond the insulating body so as to be disposed in use within and serve to reinforce each of the two building parts; at least one through apertured formation extending transversely through the insulating body so as to be able to receive in use a post-tensioning tendon member. A building system including at least one such building element, a building structure incorporating such a building system and a method of building are also described.

22 Claims, 5 Drawing Sheets

(51) Int. Cl.

| | |
|---|---|
| ***E04B 5/36*** | (2006.01) |
| ***E04C 5/06*** | (2006.01) |
| ***E04C 5/12*** | (2006.01) |

(56) References Cited

U.S. PATENT DOCUMENTS

| | | | | |
|---|---|---|---|---|
| 9,982,434 | B1 * | 5/2018 | Crigler | F16M 13/02 |
| 2007/0074477 | A1 * | 4/2007 | Fritschi | E04B 1/0038 52/404.2 |
| 2013/0276393 | A1 * | 10/2013 | Froehlich | E04B 1/80 52/407.1 |
| 2017/0001404 | A1 * | 1/2017 | Hauk | E01D 19/16 |
| 2018/0023289 | A1 * | 1/2018 | Fritschi | E04C 5/127 52/407.4 |
| 2018/0291620 | A1 * | 10/2018 | Hollerbuhl | E04B 1/0038 |
| 2019/0017256 | A1 * | 1/2019 | Michiels | E05B 65/06 |
| 2020/0002932 | A1 * | 1/2020 | Hardy | E04B 1/0038 |
| 2020/0299964 | A1 * | 9/2020 | Sorkin | E04C 5/203 |
| 2022/0243451 | A1 * | 8/2022 | Keller | E04B 1/0038 |

FOREIGN PATENT DOCUMENTS

| | | | |
|---|---|---|---|
| EP | 3202991 | A1 | 8/2017 |
| KR | 10-1462800 | B1 | 11/2014 |
| KR | 10-1552057 | B | 9/2015 |
| KR | 2016-0004481 | A | 1/2016 |
| WO | WO-03/054313 | A1 | 7/2003 |

OTHER PUBLICATIONS

International Search Report and Written Opinion issued in International Application No. PCT0GB2019/053322 dated Jan. 27, 2020. Search Report issued in GB Application No. 1819196.5 dated May 8, 2019.

* cited by examiner

BUILDING ELEMENT, SYSTEM AND METHOD

CROSS REFERENCE TO RELATED-APPLICATIONS

This application is a U.S. National Phase Application of International Application No. PCT/GB2019/053322, filed Nov. 25, 2019, which claims the benefit of Great Britain Patent Application No. 1819196.5, filed Nov. 26, 2018, which are hereby incorporated by reference in their entirety.

The invention relates to a building element adapted to provide thermal insulation between two building parts, in particular between a floor or wall part of a building and a building part adapted to protrude from the building, such as a balcony. The invention in particular relates to a building element comprising an insulating body and reinforcement elements to reinforce tensile, compression, shear and bending moment performance crossing said insulating body to be connectable to each of the two construction parts. The invention further relates to a building system including at least one such building element, to a built structure making use of such a building system, and to a method of making a built structure.

INTRODUCTION

Balconies are a common feature in buildings. In a typical traditional balcony construction, a floor part may be extended to protrude beyond the wall to create the balcony. In such a basic construction the concrete of the building part and any internal reinforcing are extended from the interior to create a balcony.

However, it is increasingly seen as desirable that buildings should be insulated, for example by thermal insulation on the internal or external surface of the wall. For structural reasons, the simple balcony discussed above is extended without any thermal break between the balcony portion and the interior floor portion. This creates potential thermal bridges between the respective parts where thermal insulation is not continuous. As a result, a lot of thermal energy may be lost through such structural connections.

Recently, products have been introduced to provide a connecting element that incorporates a thermal break that mitigates such thermal bridging between the balcony part and the interior floor part. The connecting element is designed to meet both the structural and thermal requirements necessary for modern balcony construction. An example of such a connecting element that has both a thermal break function and a reinforcement function comprising an insulating body and reinforcement elements crossing the insulating body to be connectable to each of the two construction parts to be joined, which are for example a floor or wall part within a building footprint and a building part adapted to protrude from the building, such as a balcony.

An example of a connecting element adapted to connect a balcony slab adjoining the outside of a building wall to a reinforced-concrete floor slab that incorporates tensile, compressive and a shear reinforcing elements and incorporating a thermal break comprising an insulating body formation of heat-insulating foam, is found in EP0402343.

A development of such a connecting element is found in EP1832690. A connector is provided to connect a balcony slab adjoining the outside of a building wall to a reinforced-concrete floor/ceiling slab which includes an insulating body and reinforcement elements crossing the insulating body that are connected to both slabs. In this connecting element, horizontally adjacent to the insulating body, at least one additional insulating body is arranged, with an additional tensile reinforcement element being provided in a lower half thereof for earthquake stress, protruding in the horizontal direction in reference to the insulating body.

Such connectors are effective in providing a thermal break between the two building parts, which can be particularly useful when provided between a floor or wall part of a building which sits within the thermally insulated building envelope and a building part adapted to protrude from the building beyond the thermally insulated building envelope, such as a balcony. Such connectors may be limited in some respects in terms of load transfer. However, any load transfer arrangement that compromises the effectiveness of the thermal break is generally not desirable. This can create conflicting design requirements.

In particular systems such as above described do not allow for post-tensioning tendons to run across the line of the thermal break for stressing to be applied at edge of balconies: live-end or dead-end anchors must instead be positioned at the edge of the post-tensioned slab, and conventionally reinforced balconies built as a second phase. This creates a number of issues including that:

- the live-end or dead-end anchors interfere with the thermal break system, which must be "broken" at anchor locations;
- the anchors and their anti-bursting reinforcement create congestion and clash with the balcony connectors;
- the rate of construction is slowed down by the erection of the balconies, which must be shored and cast only once the post-tensioned floors have been stressed.

A building element adapted to provide thermal insulation between two building parts that offers the potential to transfer and carry the anchor load for a protruding building part such as a balcony more effectively in the finished structure while avoiding excessive compromising of the thermal break is generally to be desired. In particular, a building element adapted to provide thermal insulation between a floor/ceiling slab and a balcony slab that allows for post-tensioning tendons to run across the line of the thermal break to live-end or dead-end anchors at the balcony edge while avoiding excessive compromising of the thermal break is generally to be desired.

SUMMARY OF INVENTION

In accordance with the invention in a first aspect, a building element adapted to provide thermal insulation between two building parts comprises:

- an elongate insulating body;
- a plurality of reinforcing elements passing through and projecting on either side beyond the insulating body so as to be disposed in use within and serve to reinforce each of the two building parts,
- at least one through apertured formation extending transversely through the insulating body so as to be able to receive in use a post-tensioning tendon member.

The through apertured formation provides an aperture configured to receive in use a post-tensioning tendon member for application of a post-tensioning load. It constitutes a further aperture, specifically so provided in the as-reinforced structure, and additional to any holes in the insulating body through which the primary reinforcing elements pass through and which are therefore not additionally able to receive in use a post-tensioning tendon member. For example, the through apertured formation defines an aperture in the building element being complementarily sized and shaped with respect to a post-tensioning tendon member with which it is to be used such that the post-tensioning tendon member is receivable within and passes through the through aperture in use. Preferably the through apertured formation comprises a tubular member defining a through aperture configured to receive a post-tensioning tendon member. The tubular member may for example comprise a central tubular sheath passing through the thickness of the elongate insulating body and an adaptor portion provided at each end thereof so disposed as to project beyond the first insulating body on either side thereof.

Conveniently in some embodiments the building element comprises at least one load transfer portion comprising a first insulating body with the said plurality of reinforcing elements passing through and projecting on either side beyond the first insulating body, and at least one transition portion continuously aligned with the load transfer portion and comprising a second insulating body with at least one of the said further apertured formation(s), and for example the said tubular member(s), formed in and extending transversely through the second insulating body.

More preferably in some embodiments, the building element comprises a plurality of load transfer portions and a plurality of transition portions alternately and successively aligned.

In this way the respective first insulating bodies and second first insulating bodies together form an elongate insulating body that serves as a thermal break in familiar manner as the building element is used to join two building parts.

The invention is characterized by the adaptation of the provision of at least one apertured formation, and for example at least one transition portion of the insulating body carrying such an apertured formation, which provides at least one through aperture extending transversely through the insulating body so as to be able to receive in use a post-tensioning tendon member. This at least one apertured formation constitutes a further aperture, specifically so provided and open in the as-reinforced structure so as to be able to receive in use a post-tensioning tendon member. The post-tensioning tendon member may be used in familiar manner to transfer load from a live-end anchor at a distal end of one of the building parts across the building element. In a particular preferred application of the invention the post-tensioning tendon member may be used in familiar manner to transfer load from a live-end anchor at a distal end of a balcony part across the building element and into a floor or ceiling building part to which the balcony part is engaged.

Although alternating reinforcing elements and post-tensioning tendons accommodated in apertured formations in transition elements represents a convenient configuration in many instances, the invention additionally encompasses the idea that the apertured formations for the post-tensioning tendons may be fully integrated with the reinforcing element.

The building element of the first aspect of the invention provides an effective means to allow for post-tensioning tendons to run across the line of the thermal break for stressing to be applied. For example, this may be at the far edge of balcony slabs. Alternatively, dead-end anchors may be positioned at the edge of the balcony, in which case stressing of the tendon is performed within the floor or ceiling building part to which the balcony part is engaged, or at the opposite edge of the floor or ceiling building part to which the balcony part is engaged.

The apertured formation represents a potential compromise in the thermal break. However, it allows great flexibility in design to allow this to be minimized. For example, the aperture may be sized to the minimum necessary to accommodate and fit snugly around the desired post-tensioning tendon member and/or the post-tensioning tendon member may itself be adapted to have a mechanically continuous but thermally discontinuous structure.

Thus, the building element of the first aspect of the invention provides in innovative manner an effective potential solution to the twin potentially conflicting considerations that a post-tensioning load transfer arrangement might be useful but a discontinuous thermal break is generally not desirable.

The apertured formation defines an aperture extending transversely through the insulating body so as to be able to receive in use a post-tensioning tendon member.

The aperture is conveniently sized and shaped complementarily with respect to a post-tensioning tendon member with which the building element of the first aspect of the invention is to be used, and in particular is sized and shaped so as to receive the post-tensioning tendon member in relatively snug fit. Advantageously this mitigates any breach in the thermal break.

The aperture may for example be of constant cross-section. The aperture may for example have a continuously curved perimeter, and for example have an elliptical or circular cross-section. In the preferred embodiment, wherein the apertured formation comprises a tubular member defining a through aperture, the tubular member or at least a central tubular sheath thereof passing through the thickness of the elongate insulating body may be of constant cross-section, and may have a continuously curved perimeter, and may for example be an elliptical or circular cylinder.

The elongate insulating body may comprise any suitable thermally insulating material or materials. Suitable thermally insulating materials known in the art include insulating foam formations, insulating fibre formations and the like. The elongate insulating body may comprise multiple materials and for example multiple layers of material. A possible preferred insulating material is mineral wool. A possible preferred insulating material is rigid insulating foam.

It may be preferable for the insulating material additionally to be selected to be non-combustible or combustion-resistant and/or for the insulating body additionally to include combustion-resistant structures, materials, coatings or treatments.

Where the elongate insulating body comprises one or more first and second insulating bodies the respective first insulating bodies and second insulating bodies may be identically or differently conformed.

The elongate insulating body may comprise additional structural components and for example top and bottom face plates and/or side face plates.

Preferably the reinforcing elements passing through and projecting on either side beyond the insulating body include tensile reinforcing elements. For example, the reinforcing elements passing through and projecting on either side beyond the insulating body may include tension bars. Preferably the reinforcing elements passing through and projecting on either side beyond the insulating body include shear reinforcing elements. For example, the reinforcing elements passing through and projecting on either side beyond the insulating body may include shear bars. Particularly preferably the reinforcing elements passing through and projecting on either side beyond the insulating body include both tensile and shear reinforcing elements.

Additionally, the reinforcing elements passing through and projecting on either side beyond the insulating body may include compressive reinforcing elements. For example, the reinforcing elements passing through and projecting on either side beyond the insulating body may include compression bars.

Additional reinforcing or other structural elements not passing through and projecting on either side beyond the insulating body may be included in the completed structure in familiar manner.

The reinforcing or other structural elements may for example comprise elongate rods or bars. The reinforcing elements may for example comprise steel rods or bars. The reinforcing elements may for example comprise carbon steel rods or bars, or stainless steel rods or bars, or combinations thereof. The reinforcing elements may for example comprise steel rebar. However, the invention is not limited to particular reinforcement materials and where applicable other materials, such as other metals or composite materials, may be considered.

Optionally, the building element may comprise compression stud reinforcements or other forms of compression load transfer formations or devices passing through the insulating body.

In use the building element of the invention acts as an engagement between first and second building parts, for example being a floor/ceiling slab and a balcony slab. The reinforcing elements are so arranged as to be disposed in use within and serve to reinforce each of the two building parts. The reinforcing elements may be engaged into the respective building parts for example by being cast into or adhesively bonded into the respective building parts or secured into openings within the building parts by frictional engagement. For example, the first and second building parts may be cast concrete slabs and the building element of the invention may be incorporated as a connection between the first and second building in that it is cast into them.

At least those portions of the reinforcing elements that project beyond the insulating body are preferably configured to effect such engagement. For example, at least those portions of the reinforcing elements that project beyond the insulating body may include surface structures to facilitate such engagement. For example, at least those portions of the reinforcing elements that project beyond the insulating body may be adapted to engage within cast concrete.

The building element of the first aspect of the invention provides a means to allow post-tensioning tendons to be run across the line of the thermal break through the through apertures within the insulating body.

Accordingly, in a second aspect of the invention, a building system adapted to provide thermal insulation between two building parts is provided comprising:

- at least one building element according to the first aspect of the invention; at least one post-tensioning tendon;
- each through aperture in the building element being complementarily sized and shaped with respect to each post-tensioning tendon member so that the post-tensioning tendon member is receivable within and passes through the through aperture in use.

Advantageously the through aperture is sized and shaped so as to receive the post-tensioning tendon member in relatively snug fit.

The post-tensioning tendon member preferably comprises plural elongate tendon strands and for example plural steel strands in familiar manner. Optionally the post-tensioning tendon member comprises a three-strand or five-strand tendon.

The post-tensioning tendon member may include suitable surface structures and/or coatings in familiar manner, and for example the post-tensioning tendon member, and where applicable the plural elongate tendon strands thereof, may be surrounded by a protective sheath, for example of a plastics material. For example, the post-tensioning tendon member comprises plural elongate steel tendon strands surrounded by a protective sheath or individually sheathed plural elongate steel tendon strands The post-tensioning tendon member comprises a mechanically continuous elongate member configured to extend in use through the through aperture and be mechanically engaged to and thereby anchored to a building part at either end remotely therefrom. Advantageously the post-tensioning tendon member therefore comprises anchor formations at each end configured to anchor the end of the post-tensioning tendon member to a building part during use. Additionally or alternatively, the system of the second aspect of the invention comprises anchor formations configured to anchor an end of the post-tensioning tendon member to a building part during use.

The anchor formations may comprise a passive or dead-end and active or live-end anchor pair, one provided at either end of the post-tensioning tendon member, as will be familiar. In the preferred use of the invention to apply a post-tensioning to a connection between a floor or ceiling slab and a balcony slab, the live-end anchor will preferably but not necessarily be used to anchor the distal end of the balcony slab in situ and apply a post-tensioning thereto.

The post-tensioning tendon member may be characterized by a mechanically continuous but thermally discontinuous structure. For example, the post-tensioning tendon member may comprise conventional structural tendons and for example multi-strand steel tendons at either end, and a central formation therebetween of thermally insulating material.

The system of the second aspect of the invention is adapted to allow for post-tensioning tendons to run across the line of the thermal break to apply a post-tensioning stress to a connection between two building parts in a built structure and for example to apply a post-tensioning stress to a connection between a floor or ceiling slab and a balcony slab.

Accordingly, in a third aspect of the invention, a building structure is provided comprising:

- a building system according to the second aspect of the invention comprising a building element having an elongate insulating body, a plurality of reinforcing elements passing through and projecting on either side beyond the insulating body, and at least one through apertured formation extending transversely through the insulating body;
- and a post-tensioning tendon member;
- a first building part engaged with the reinforcing elements on a first side of the building element;
- a second building part engaged with the reinforcing elements on a second side of the building element;
- wherein the post-tensioning tendon member is received within and passes through the through aperture and is tensioned to apply a post-tensioning load to the building structure.

Preferably the first building part is a floor or ceiling slab and the second building part is a balcony slab and the post-tensioning tendon is tensioned to apply a post-tensioning load between the ceiling slab and the balcony slab.

Preferably the post-tensioning tendon member comprises anchor formations at each end anchored to the respective first and second building parts. Preferably the anchor formations are anchored to the respective first and second building parts at an edge thereof distal of an edge that abuts the building element.

The building element acts as an engagement between first and second building parts. The reinforcing elements are engaged within and serve to reinforce the two building parts. The reinforcing elements may be engaged into the respective building parts for example by being cast into or adhesively bonded into the respective building parts or secured into openings within the building parts by frictional engagement. For example, the first and second building parts may be cast concrete slabs and the reinforcing elements may be incorporated therein by casting.

A structure of the third aspect of the invention thus embodies a system of the second aspect of the invention which itself uses an element of the first aspect of the invention, and other preferred features of one aspect will be understood to apply to other aspects where applicable by analogy.

In accordance with the invention in a fourth aspect, a method of building comprises the steps of:

deploying a building element comprising an elongate insulating body and a plurality of reinforcing elements passing through and projecting on either side beyond the insulating body between two building parts such that the reinforcing elements are disposed within and serve to reinforce each of the two building parts;

providing at least one through apertured formation extending transversely through the insulating body suitable to receive a post-tensioning tendon member.

A more complete refinement of the method comprises:

deploying a post-tensioning tendon member within and passing through the through aperture;

tensioning the post-tensioning tendon member to apply a post-tensioning load between the two building parts.

Preferably one of the building parts is a floor or ceiling slab and the other of the building parts is a balcony slab and the post-tensioning tendon is tensioned to apply a post-tensioning load between the floor or ceiling slab and the balcony slab.

Preferably the post-tensioning tendon member comprises anchor formations at each end and the method comprises anchoring an anchor formation to each of the building parts. Preferably the anchor formations are anchored to the respective building parts at an edge thereof distal of an edge that abuts the building element.

Preferably, the anchor formations comprise a passive or dead-end and active or live-end anchor pair.

Preferably, one of the building parts is a floor or ceiling slab and the other of the building parts is a balcony slab. The live end anchor may be suitably anchored with respect to the balcony slab to enable a post-tensioning load to be applied.

The method of the fourth aspect of the invention may thus use a system of the second aspect of the invention to make a built structure of the third aspect of the invention, and other preferred features of one aspect will be understood to apply to other aspects where applicable by analogy.

BRIEF DESCRIPTION OF DRAWINGS

The invention will now be described by way of example only with reference to FIGS. 1 to 6 of the accompanying drawings, in which.

DETAILED DESCRIPTION

Figure 1:
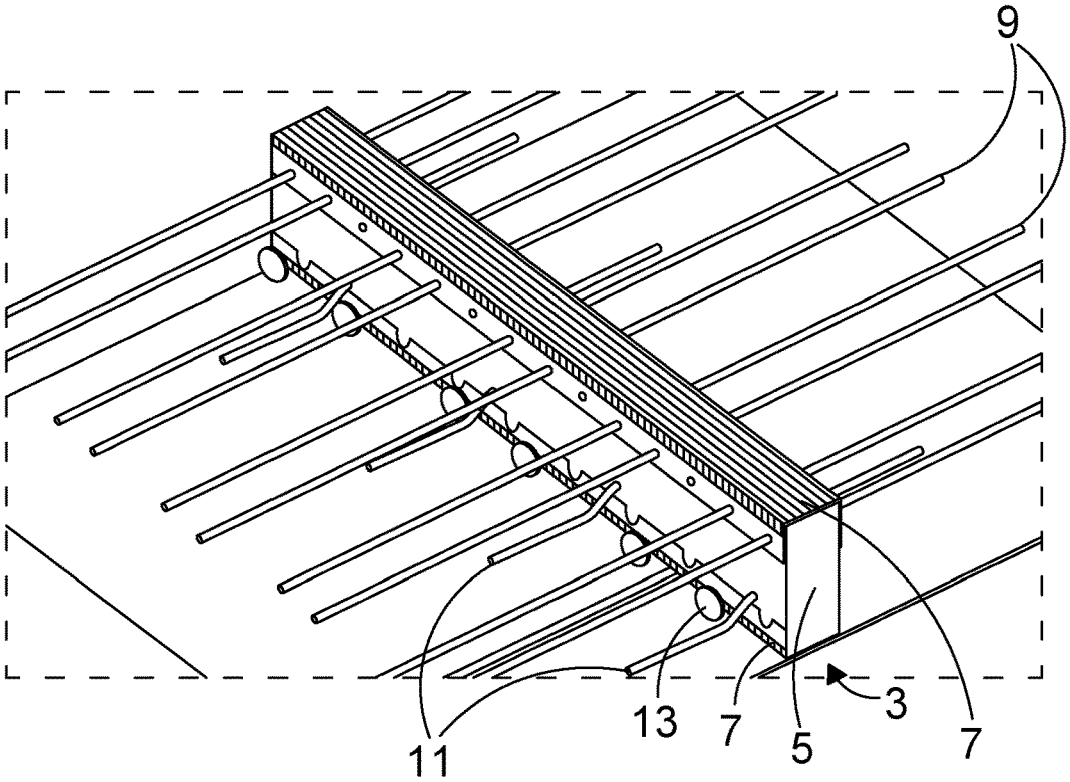
PRIOR ART FIG. 1
FIGS. 1 to 3 illustrate an example of a prior art thermally insulated balcony connection system.
Figure 2:
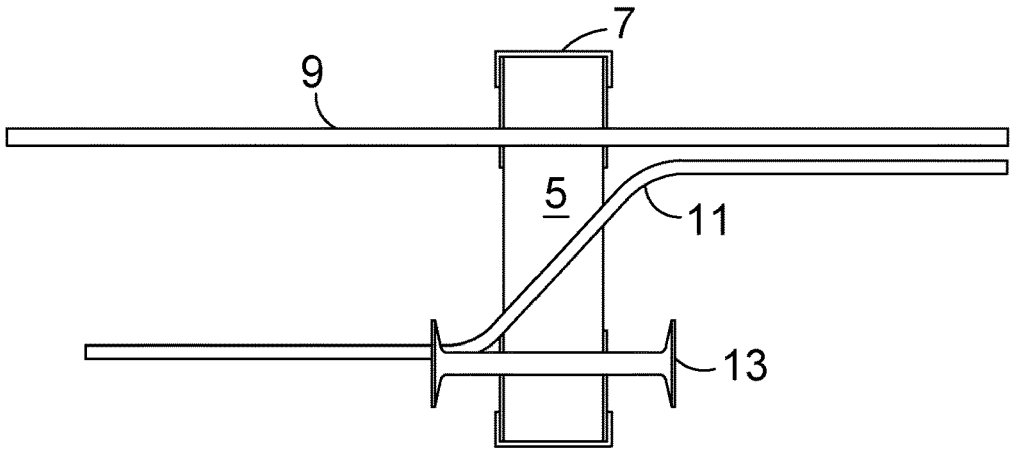
PRIOR ART FIG. 2
Figure 3:
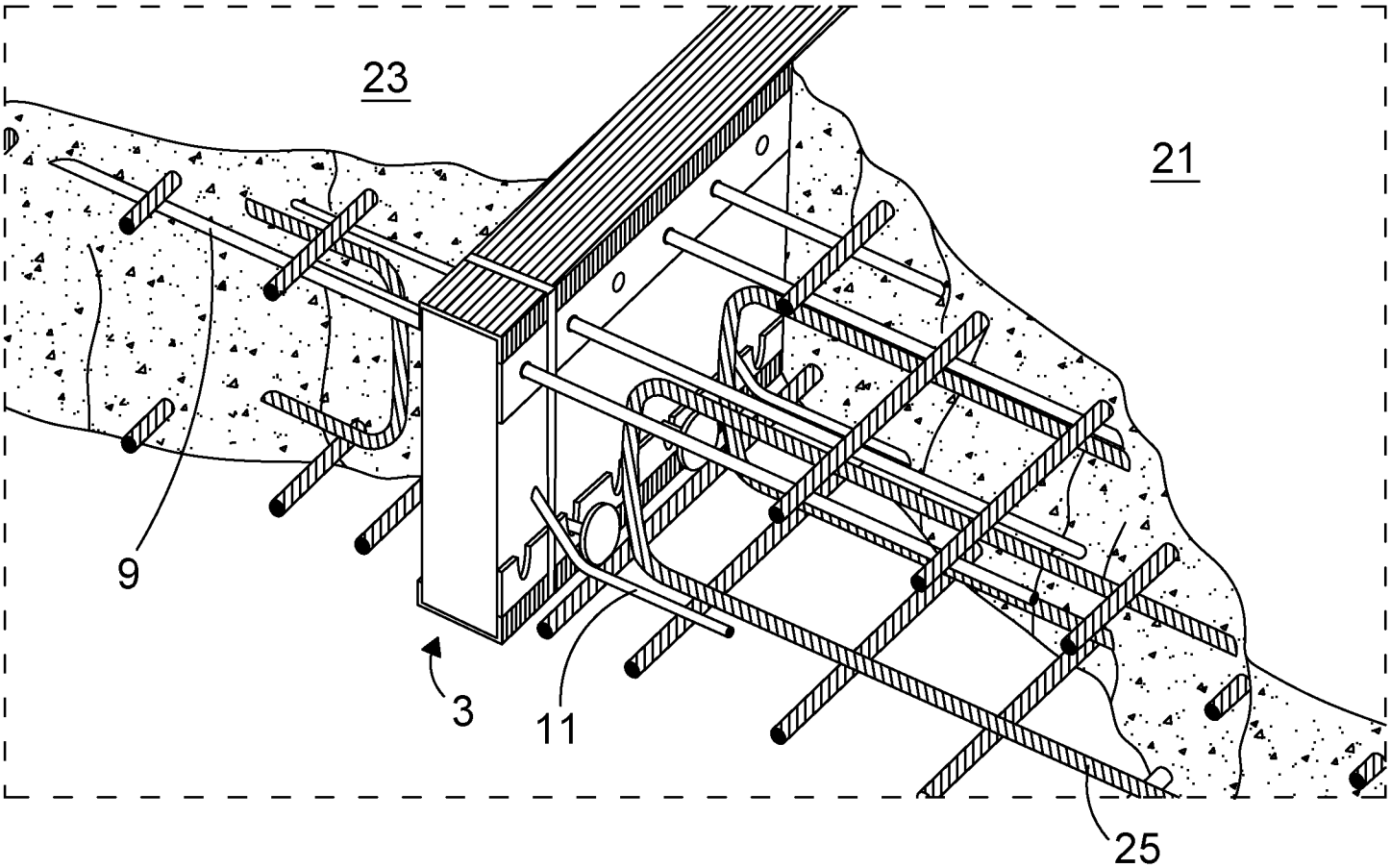
PRIOR ART FIG. 3

FIGS. 1 to 3 illustrate an example prior art thermally insulated balcony connection system for effecting a connection between two building slabs so as to include a thermal break between the two slabs but to provide for continuous reinforcement through the thermal break.

The illustrated example of the prior art is a high performance thermal break system for concrete-to-concrete applications, and in particular for the joining of a floor slab within the building envelope to a balcony slab projecting outside. A modular principle of construction is typically applied, with multiple modular building elements incorporating the thermal break and necessary reinforcement structures being used to form a complete structure. The principle is illustrated in FIGS. 1 to 3.

In FIG. 1, a building element module incorporating a thermal break and reinforcement structures is shown in perspective view. FIG. 2 shows a vertical cross-section of the modular building element illustrated in FIG. 1. In each case, the building element is shown as it would be supplied, and in particular therefore not including the concrete slabs in place.

The building element consists of an elongate insulating body which extends to provide the thermal break in use, and which in the embodiment comprises fire-resistant mineral wool (5) shaped and protected by a plastic U-shaped profile element (7) at the top and bottom. Other materials, for example including insulating foams, may be used in alternative installations.

The building element includes various reinforcing elements which pass through and project on either side beyond the insulating body and in use, as illustrated in FIG. 3, engage within the two concrete slabs. These comprise tensile (9) and shear (11) bars and compression studs (13).

In the illustrated embodiment, the tensile and shear reinforcement bars (9, 11) consist of 1.4301 stainless steel with the characteristics of BS500S. The tensile bars are continuous with no structural welding or point of weakness. The compression studs (13) are manufactured from 12 mm diameter high resistance 1.4301 stainless steel bars with hot-forged heads.

In addition to thermal and durability benefits, stainless steel reinforcement reduces concrete cover requirements and can therefore provide additional design efficiencies over carbon steel systems. However, material selection in this embodiment is illustrative only, and the skilled person would readily be able to choose other suitable reinforcement materials, for example including carbon steel systems, other metal systems and composite systems as applicable.

A building element module such as is illustrated in FIGS. 1 and 2 is shown in situ in use in FIG. 3 as a thermal break connection between first and second building slabs (21, 23) which may in the preferred application of the prior art system be a floor slab and a balcony slab.

In the illustrated example the slabs comprise conventional concrete slabs cast in situ, and are shown with the building element (3) in position to act as a thermal break between them. The rebar through reinforcements (9, 11) cooperate with the additional structural framework elements (25) within the two concrete slabs to provide structure within the concrete and in particular to provide a mechanism to transfer bending moment and shear forces across the thermal break whilst minimising compromise of the thermal insulation provided by the inherently fire-resistant mineral wool. The continuous stainless steel reinforcement through the building element maximises strength, thermal efficiency and corrosion protection whilst the compression studs reduce rebar reinforcement congestion and simplify installation.

A primary limitation with the prior art system that the invention seeks to address is the difficulty it presents if it desired to build in post-construction tensioning to apply a post-tensioning load between the floor slab and the balcony slab. The system does not allow for post-tensioning tendons to run across the line of the thermal break in a manner which would allow stressing to be applied to a live-end anchor at the far balcony edge. The key to the invention, as discussed with reference to the embodiment below, is develop a modification to modular systems of which FIGS. 1 to 3 are illustrative that enables post-tensioning tendons to run straight through the thermal break and thereby to enable live-end anchors to be positioned at the edges of balconies.

Accordingly, although FIGS. 1 to 3 above are presented as illustrative of a prior art modular connection system, and discussion of features, materials and construction principles is made in that context, it will be understood that the key to the invention is the way in which such systems are modified to allow for the provision of post-tensioning tendons. It is likely that other aspects of conventional modular systems such as are illustrated in FIGS. 1 to 3 will be applicable to, and even desirable in, embodiments of the invention and accordingly those other features, materials and construction principles described with reference to FIGS. 1 to 3 may also be seen as applicable to embodiments of the invention where appropriate.

Figure 4:
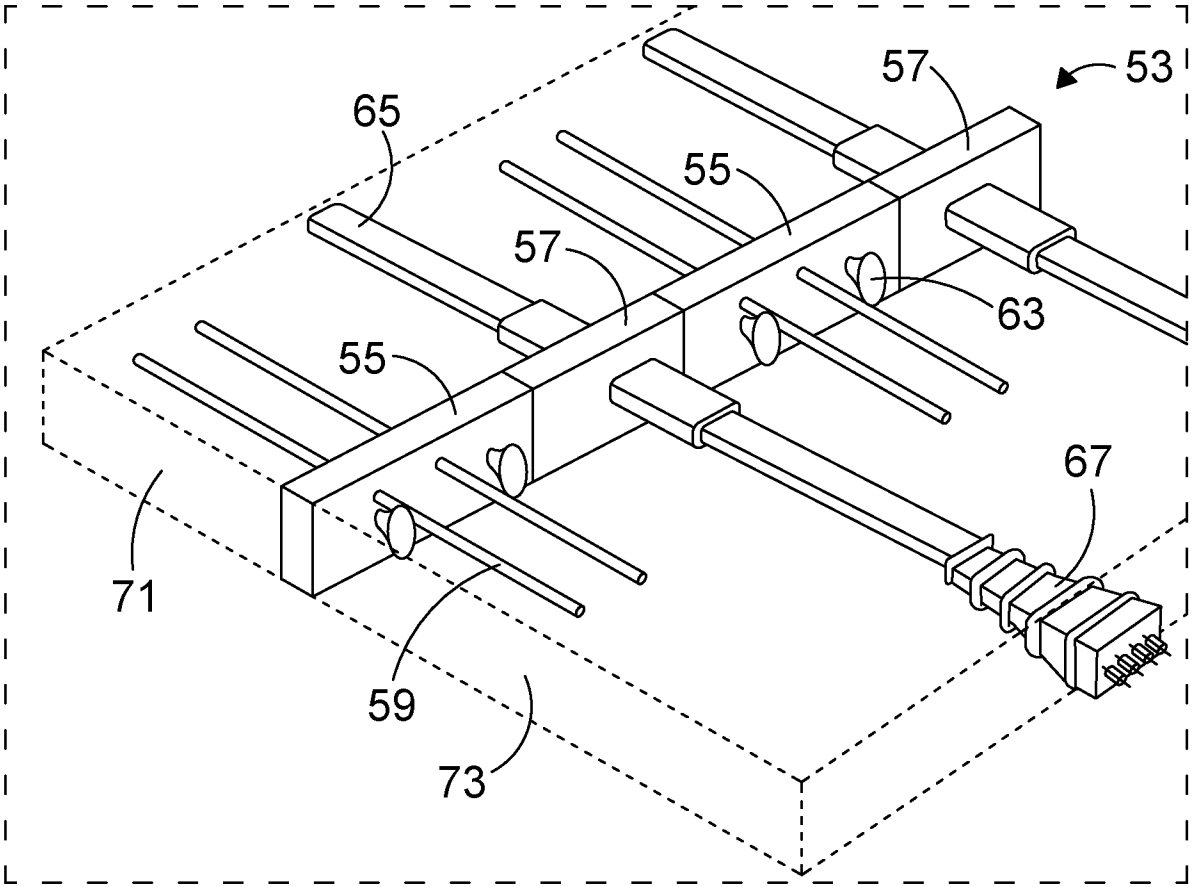
FIGS. 4 to 6 illustrate balcony connection systems comprising embodiments of the invention.
Figure 5:
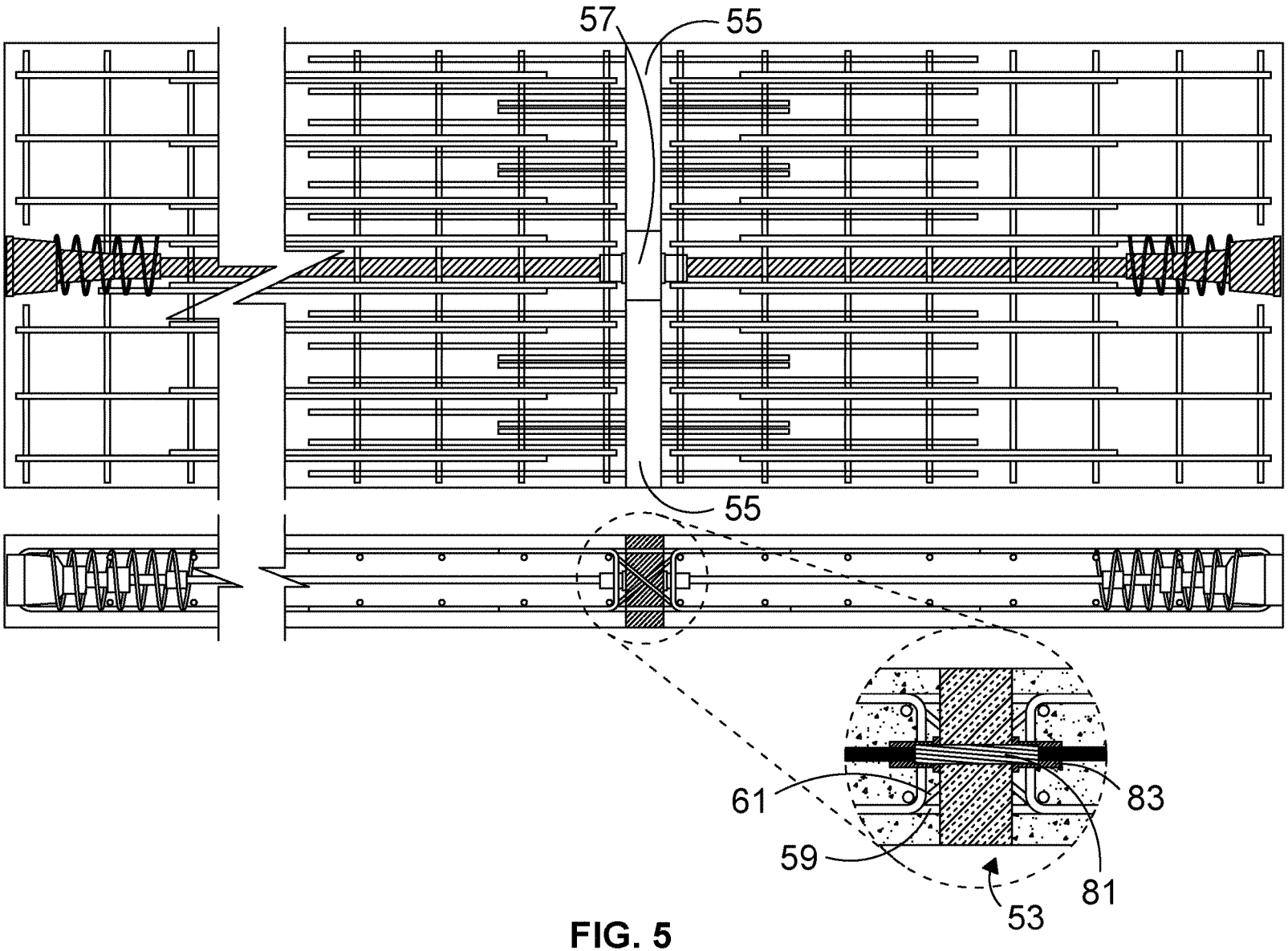
Figure 6:
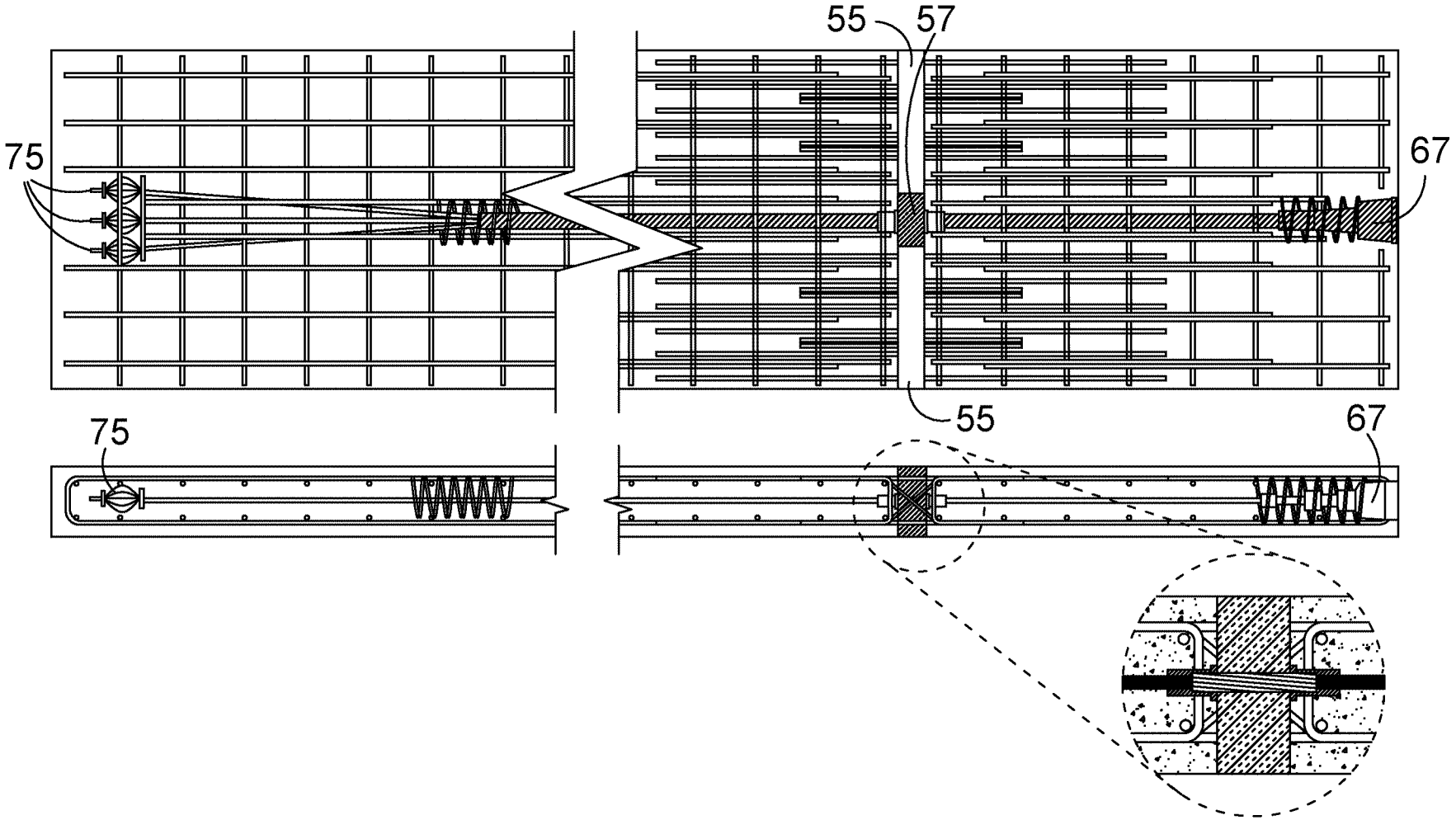

Embodiments of the invention, illustrated in FIGS. 4 to 6, attempt to develop the principles of a modular system such as might be embodied in the example in FIGS. 1 to 3 to enable post-tensioning tendons to be run through the thermal break to allow live-end or dead-end anchors to be positioned at the edge of balconies and apply a post-tensioning load with the attendant advantages to the resultant built structure that will then accrue.

The invention achieves this additional functionality by providing at least one through aperture formation extending transversely through the insulating body so as to provide a means to receive a post-tensioning tendon member and apply a post-tensioning load. This post-tensioning tendon member is supplementary to the rebar.

In the illustrated embodiment this is effected in that the insulating body consists of successively arranged load carrying load transfer portions or transfer units and apertured transition portions for receiving the post-tensioning tendons. This is an effective configuration in many circumstances, although it is presented as an illustrative embodiment only, and the skilled person will appreciate that in alternative embodiment the apertures for the post-tensioning tendons may be fully integrated with the reinforcing element.

In the illustrated embodiment the load transfer portions or transfer units comprise primary load transfer units of generally conventional design in that they embody the principles of the prior art to carry the combination of bending moment, shear and compression across the thermal break, in particular including through reinforcements that pass through the insulating body. The transition portions comprise short transition elements or portions disposed between the primary load transfer units that define apertured portions through which the tendons may be passed. These apertured portions are additional to any holes inherent in the body where the primary through reinforcements pass through, and are open in the as-reinforced state, and for example define an open aperture that is complementarily sized and shaped with respect to a post-tensioning tendon member with which it is to be used, such that the post-tensioning tendon member is receivable within and passes through the through aperture in use.

This concept is illustrated in a first example embodiment shown in partially cutaway perspective view in FIG. 4 and in a second example embodiment in schematic plan view and vertical section in FIG. 5 and a third example embodiment in schematic plan view and vertical section in FIG. 6.

The illustrated embodiments of the invention have a number of general features in common, and these are where applicable referenced by the same reference numeral. Where a variant feature is shown in a given embodiment, it will be appreciated that this is by way of example only and that except where this feature is necessarily technically linked to other features of the embodiment, such a variant would be interchangeably applicable to each embodiment.

In the illustrated embodiments of the invention, an insulating body (53) comprises a plurality of load transfer elements (55) which may be discrete load transfer units or suitable portions of an integral insulating body and a plurality of transition elements (57) which may be discrete transition units or suitable portions of an integral insulating body which are alternately and successively aligned to make up the insulating body (53). For illustrative purposes, a portion of an embodiment of the invention including multiple such alternating load transfer elements (55) and transition elements (57) is shown in FIG. 4. FIGS. 5 and 6 show a portion of an embodiment of the invention including two load transfer elements (55) with a transition element (57) between.

The load transfer elements (55) are configured to transfer load across the thermal break in familiar manner, and in the illustrated embodiments include tensile elements (59), and elements to transfer shear and compression, which by way of illustrative example include the compression studs (63) of FIG. 4 and the arrangement of elongate members (59, 61) to transfer compression and shear shown in the inset of FIGS. 5 and 6.

The load transfer elements may embody any known materials and principles of construction including those which might be embodied in similar prior art modular thermal break systems such as illustrated in FIGS. 1 to 3. In particular, in the preferred embodiment illustrated in FIGS. 4 to 6 the thermal insulation may for example comprise fire-resistant mineral wool, and the tension, compression and shear reinforcement may comprise suitable steel, and for example stainless steel, for example being 1.4301 stainless steel with the characteristics of BS500S. Other materials may be selected as applicable for other applications.

The invention is characterised by the provision of transition elements (57) which define apertured portions that allow post tensioning tendons (65) to pass through the thermal break.

FIG. 4 illustrates the system in situ joining a floor slab (71) and a balcony slab (73). The outermost edge of the balcony slab (73) carries a live-end anchor (67) by means of which a post-tensioning load can be applied using the tendon (65). The live-end anchor can be employed without interference to the thermal break system, which need not be broken at anchor locations. The load transfer principles of conventional modular thermal break systems need not be compromised, and can be otherwise employed, for example by provision of alternating conventional load transfer units and transition units in the manner of the illustrated embodiment.

FIG. 5 illustrates the system with a live-end anchor (67) at either end by means of which a post-tensioning load can be applied using the tendon. In many practical applications, it will be more appropriate to have a dead end anchor at one end, as is illustrated by FIG. 6, in which a tendon extends between a live-end anchor (67) at a first end and a dead end anchor (75) at the other. The anchor formations thus comprise a passive and active anchor pair. In a typical construction to which the invention could be applied, where one of the building parts is a floor or ceiling slab and the other of the building parts is a balcony slab, the live end anchor may be suitably anchored with respect to the balcony slab to enable a post-tensioning load to be applied.

The principles behind active or live-end and passive or dead-end anchors are well established and the skilled person will understand that any example shown here is illustrative only. In particular, the skilled person will appreciate that the invention could readily be applied to the range of single and multiple bonded and unbonded anchorage structures that might generally be known for post-tensioning systems.

The load transfer elements may for example be 300 mm long and embody similar design principles to existing thermal breaks with load transfer formations such as those illustrated with reference to FIGS. 1 to 3, although the amount of compression generated by the post-tensioning tendons of an embodiment of the invention in use is likely to require modification to the number and position of the compression studs.

The transition elements between load transfer elements may be typically 150 mm long and fitted with a transition tube to define and line a single aperture therein. This arrangement is most clearly shown in the inset in FIGS. 5 and 6. A transition tube is shown consisting of a central sleeve (81) and adaptor portions (83) which in the embodiment are fabricated from a suitable plastics material but may alternatively be metallic for example for combustion resistance. A central sleeve (81) defines the aperture, and provides a duct for the post-tensioning tendons strands to pass. In the example it has an oval cross-section, but circular or other cross-sections may be appropriate.

The post-tensioning tendon may be of any suitable conventional design, for example including multiple steel strands, and is for example a three or five strand system. It may be made modular to allow for adjustment of design centre. It may be bonded or unbonded. When a bonded post-tensioning system configuration is used, standard galvanised ducting or plastic ducting as is routinely supplied with post-tensioning tendon systems will be inserted at each extremity and fitted with heat-shrink sleeves or other suitable means to form a continuous tendon. When an unbonded post-tensioning system configuration with individual plastic-coated strands is used, the strands may be simply inserted through the transition tube without further precautions.

In a typical concept for assembly on site, multiple building elements such as are illustrated in FIGS. 4 to 6 would be delivered along with multiple post-tensioning tendons, and these building elements would be placed end to end to form a continuous thermal break through which the post-tensioning elements could be inserted to apply a post-tensioning load to the balcony parts.

This system thus combines the structural and thermal features of known thermal break systems with the ability to apply the post-tensioning load in the manner described. Advantages include: speed of installation as the tendons will run straight through the thermal break; allowing concrete to be cast in the usual manner simultaneously for floor and balcony; absence of interference between live-end anchors and balcony connectors.

The invention claimed is:

1. A building element adapted to provide thermal insulation between two building parts comprising:

an elongate insulating body;

a plurality of reinforcing elements passing through and projecting on either side beyond the insulating body so as to be disposed in use within and serve to reinforce each of the two building parts;

at least one through apertured formation extending transversely through the insulating body so as to be able to receive in use a post-tensioning tendon member, wherein:

the insulating body comprises at least one load transfer element and at least one transition element continuously aligned with the load transfer element, the at least one load transfer element comprises a first insulating body with the said plurality of reinforcing elements passing through and projecting on either side beyond the first insulating body, the at least one transition element comprises a second insulating body with at least one of the said apertured formations formed in and extending transversely through the second insulating body, the through apertured formation comprises a tubular member defining a through aperture, and the tubular member comprises a central tubular sheath passing through the thickness of the elongate insulating body and an adaptor portion provided at each end thereof so disposed as to project beyond the first insulating body on either side thereof.

2. The building element in accordance with claim 1 wherein the through apertured formation defines an aperture in the building element being complementarily sized and shaped with respect to a post-tensioning tendon member such that the post-tensioning tendon member is receivable within and passes through the through aperture in use.

3. The building element in accordance with claim 1 comprising a plurality of load transfer portions and a plurality of transition portions alternately and successively aligned.

4. The building element in accordance with claim 1, wherein the apertured formation defines an aperture of constant cross-section.

5. The building element in accordance with claim 4 wherein at least the central tubular sheath passing through the thickness of the elongate insulating body is of constant cross-section.

6. The building element in accordance with claim 1, wherein the reinforcing elements passing through and projecting on either side beyond the insulating body comprise one or more of: tensile reinforcing elements; shear reinforcing elements; compressive reinforcing elements.

7. The building element in accordance with claim 1, wherein the reinforcing elements comprise steel rods or bars.

8. The building element in accordance with claim 1, wherein at least those portions of the reinforcing elements that project beyond the insulating body are adapted to engage within cast concrete.

9. A building system adapted to provide thermal insulation between two building parts is provided comprising:

at least one building element including:

an elongate insulating body;

a plurality of reinforcing elements passing through and projecting on either side beyond the insulating body so as to be disposed in use within and serve to reinforce each of the two building parts; and at least one through apertured formation extending transversely through the insulating body so as to be able to receive in use a post-tensioning tendon member;

at least one post-tensioning tendon;

each through aperture in the building element being complementarily sized and shaped with respect to each post-tensioning tendon member so that the post-tensioning tendon member is receivable within and passes through the through aperture in use, wherein:

the insulating body comprises at least one load transfer element and at least one transition element continuously aligned with the load transfer element;

the at least one load transfer element comprises a first insulating body with the said plurality of reinforcing elements passing through and projecting on either side beyond the first insulating body, the at least one transition element comprises a second insulating body with at least one of the said apertured formations formed in and extending transversely through the second insulating body, the through apertured formation comprises a tubular member defining a through aperture, and the tubular member comprises a central tubular sheath passing through the thickness of the elongate insulating body and an adaptor portion provided at each end thereof so disposed as to project beyond the first insulating body on either side thereof.

10. The building system in accordance with claim 9 wherein the through aperture is sized and shaped so as to receive the post-tensioning tendon member in relatively snug fit.

11. The building system in accordance with claim 9 wherein the post-tensioning tendon comprises plural elongate steel tendon strands surrounded by a protective sheath or individually sheathed plural elongate steel tendon strands.

12. The building system in accordance with claim 9 wherein the post-tensioning tendon member comprises a mechanically continuous elongate member configured to extend in use through the through aperture and provided with integral or separate anchor formations at each end configured to anchor the end of the post-tensioning tendon member to a building part during use.

13. A building structure comprising:

a building system comprising:

a building element having an elongate insulating body, a plurality of reinforcing elements passing through and projecting on either side beyond the insulating body, and at least one through apertured formation extending transversely through the insulating body, and a post-tensioning tendon member;

at least one post-tensioning tendon;

each through aperture in the building element being complementarily sized and shaped with respect to each post-tensioning tendon member so that the post-tensioning tendon member is receivable within and passes through the through aperture in use;

a first building part engaged with the reinforcing elements on a first side of the building element;

a second building part engaged with the reinforcing elements on a second side of the building element;

wherein:

the post-tensioning tendon member is received within and passes through the through aperture and is tensioned to apply a post-tensioning load to the building structure, the insulating body comprises at least one load transfer element and at least one transition element continuously aligned with the load transfer element, the at least one load transfer element comprises a first insulating body with the said plurality of reinforcing elements passing through and projecting on either side beyond the first insulating body, the at least one transition element comprises a second insulating body with at least one of the said apertured formations formed in and extending transversely through the second insulating body, the through apertured formation comprises a tubular member defining a through aperture, and the tubular member comprises a central tubular sheath passing through the thickness of the elongate insulating body and an adaptor portion provided at each end thereof so disposed as to project beyond the first insulating body on either side thereof.

14. The building structure in accordance with claim 13 wherein the post-tensioning tendon member comprises anchor formations at each end anchored to each of the building parts.

15. The building structure in accordance with claim 13 wherein each building part is a cast concrete slab.

16. The building structure in accordance with claim 13 wherein the first building part is a floor or ceiling slab and the second building part is a balcony slab and the post-tensioning tendon is tensioned to apply a post-tensioning load between the ceiling slab and the balcony slab.

17. A method of building comprising the steps of:

deploying a building element, the building element comprising:

an elongate insulating body, a plurality of reinforcing elements passing through and projecting on either side beyond the insulating body between two building parts such that the reinforcing elements are disposed within and serve to reinforce each of the two building parts, at least one through apertured formation extending transversely through the insulating body so as to be able to receive in use a post-tensioning tendon member, wherein:

the insulating body comprises at least one load transfer element and at least one transition element continuously aligned with the load transfer element, the at least one load transfer element comprises a first insulating body with the said plurality of reinforcing elements passing through and projecting on either side beyond the first insulating body, the at least one transition element comprises a second insulating body with at least one of the said apertured formations formed in and extending transversely through the second insulating body, the through apertured formation comprises a tubular member defining a through aperture, and the tubular member comprises a central tubular sheath passing through the thickness of the elongate insulating body and an adaptor portion provided at each end thereof so disposed as to project beyond the first insulating body on either side thereof; and providing at least one through apertured formation extending transversely through the insulating body suitable to receive a post-tensioning tendon member.

18. The method of building in accordance with claim 17 wherein the through apertured formation defines an aperture in the building element being complementarily sized and shaped with respect to a post-tensioning tendon member with which it is to be used such that the post-tensioning tendon member is receivable within and passes through the through aperture in use.

19. The method of building in accordance with claim 17 further comprising the steps of:

deploying a post-tensioning tendon member within and passing through the through aperture;

tensioning the post-tensioning tendon member to apply a post-tensioning load between the two building parts.

20. The method of building in accordance with claim 17 wherein one of the building parts is a floor or ceiling slab and the other of the building parts is a balcony slab and the post-tensioning tendon is tensioned to apply a post-tensioning load between the floor or ceiling slab and the balcony slab.

21. The method of building in accordance with claim 20 wherein the post-tensioning tendon member comprises anchor formations at each end and the method comprises anchoring an anchor formation to each of the building parts.

22. The method of building in accordance with claim 21 wherein the anchor formations comprise a passive or dead-end and active or live-end anchor pair.

* * * * *